US007673845B2

(12) United States Patent
Dam et al.

(10) Patent No.: US 7,673,845 B2
(45) Date of Patent: Mar. 9, 2010

(54) LEVELING ASSEMBLY

(75) Inventors: Robert Dam, Aurora, IL (US); Chong B. Wong, Vernon Hills, IL (US)

(73) Assignee: Illinois Tool Works Inc., Glenview, IL (US)

( * ) Notice: Subject to any disclaimer, the term of this patent is extended or adjusted under 35 U.S.C. 154(b) by 40 days.

(21) Appl. No.: 11/701,827

(22) Filed: Feb. 2, 2007

(65) Prior Publication Data

US 2007/0267561 A1 Nov. 22, 2007

Related U.S. Application Data

(60) Provisional application No. 60/801,777, filed on May 19, 2006.

(51) Int. Cl.
*A47B 91/02* (2006.01)
*D06F 39/12* (2006.01)

(52) U.S. Cl. ..... 248/615; 248/188.8; 248/677

(58) Field of Classification Search ..... 248/615, 248/188.8, 677, 188.9, 616, 623, 188.4, 188.2
See application file for complete search history.

(56) References Cited

U.S. PATENT DOCUMENTS

| | | | | | |
|---|---|---|---|---|---|
| 1,273,939 | A | * | 7/1918 | Sidel | 248/188.3 |
| 1,866,274 | A | * | 7/1932 | Stoller | 248/562 |
| 2,224,348 | A | * | 12/1940 | Holland | 248/603 |
| 2,795,892 | A | * | 6/1957 | Lautenbacher et al. | 248/188.3 |
| 2,852,883 | A | * | 9/1958 | Walsh | 248/188.9 |
| 2,931,626 | A | * | 4/1960 | Beach et al. | 254/1 |
| 3,520,547 | A | | 7/1970 | Anthony | |
| 4,798,359 | A | * | 1/1989 | Ball | 248/188.3 |
| 5,156,451 | A | * | 10/1992 | Pollock | 312/351.3 |
| 5,332,182 | A | * | 7/1994 | Weisz et al. | 248/188.4 |
| 5,344,116 | A | * | 9/1994 | Winkler | 248/677 |
| 5,490,648 | A | * | 2/1996 | Cullen | 248/188.3 |
| 5,697,586 | A | * | 12/1997 | Lybarger | 248/188.4 |
| 6,027,086 | A | * | 2/2000 | Heitlinger et al. | 248/188.5 |
| 6,142,431 | A | | 11/2000 | Herzog | |
| 6,520,461 | B1 | * | 2/2003 | Graham | 248/188.8 |
| 7,314,206 | B2 | * | 1/2008 | Lee et al. | 248/655 |
| 2005/0116134 | A1 | | 6/2005 | Lee et al. | |
| 2005/0279895 | A1 | * | 12/2005 | Lee et al. | 248/188.8 |
| 2006/0102815 | A1 | | 5/2006 | Erdmann et al. | |
| 2007/0262213 | A1 | * | 11/2007 | de Toledo et al. | 248/188.8 |
| 2009/0212193 | A1 | * | 8/2009 | Neibert et al. | 248/615 |

FOREIGN PATENT DOCUMENTS

| | | | |
|---|---|---|---|
| GB | 2416801 | A * | 2/2006 |
| JP | 02154831 | A * | 6/1990 |
| KR | 2005050308 | A * | 5/2005 |
| KR | 2005050309 | A * | 5/2005 |
| KR | 2006007465 | A * | 1/2006 |

* cited by examiner

*Primary Examiner*—Anita M King
(74) *Attorney, Agent, or Firm*—Mark W. Croll; Paul F. Donovan

(57) ABSTRACT

Embodiments of the present invention provide a leveling assembly configured to be secured to an appliance. The leveling assembly supports the appliance on a floor, and includes a base having a column integrally connected to a ledge, which is integrally connected to a stem. The assembly also includes a spring positioned around the stem, and a sleeve secured to the stem and positioned around the spring. The spring exerts equal and opposite forces into the sleeve and the ledge, respectively.

15 Claims, 2 Drawing Sheets

LEVELING ASSEMBLY

RELATED APPLICATIONS

This application relates to and claims priority benefits from U.S. Provisional Patent Application No. 60/801,777 entitled "Dampened Leveling Foot Assembly," filed May 19, 2006, which is hereby incorporated by reference in its entirety.

FIELD OF THE INVENTION

Embodiments of the present invention generally relate to a leveling assembly, and more particularly, to a leveling assembly that is configured to be used with various household appliances, such as a washing machine.

BACKGROUND OF THE INVENTION

Conventional leveling feet are screwed into the bottom of an appliance and are independently adjusted to level the appliance when it is installed at a particular location. Typically, each leveling foot is a unitary piece of plastic that includes a base that rests on a floor and an externally threaded body that is screwed into an underside of an appliance. The threaded interface typically includes a helical impression specified by a manufacturer to ensure optimal performance. An exemplary leveling foot is shown and described in U.S. Pat. No. 6,142,431, entitled "Furniture Leveling Foot And System."

Leveling feet may be used with washers, dryers, ranges, refrigerators, and various other appliances. Washing machines, for example, include internal components that spin at rates in excess of 1,000 revolutions per minute. The combination of the high spin rate and load imbalances may vibrate the washing machine and produce noise due to the vibration. For example, if a washing machine is not properly leveled, operation of the washing machine causes the washing machine to vibrate and produce loud noises.

Typical washing machines are leveled using threaded feet that screw into a weld nut on the bottom of the washing machines. In particular, one foot is securely positioned proximate each corner of a washing machine. Ideally, each foot is adjusted by a consumer or installer until the bottom of the washing machine resides in a level plane. After the feet are adjusted, a locknut is secured to each foot to prevent loosening.

Unfortunately, however, the leveling procedure described above is rarely followed. The leveling process is an extremely tedious procedure. For example, a consumer or installer needs to adjust the rear feet of the washing machine, which are typically close to a wall. In order to gain access to these rear feet, the consumer or installer needs to move the heavy, cumbersome washing machine away from the wall. Consequently, a typical washing machine is rarely moved to adjust the rear feet for leveling purposes.

Thus, a need exists for a leveling foot assembly that dampens vibration and provides automatic adjustment.

SUMMARY OF THE INVENTION

Certain embodiments of the present invention provide a leveling assembly configured to be secured to an appliance, such as a washing machine, wherein the leveling assembly supports the appliance on a floor. The leveling assembly includes a base, a spring, and a sleeve.

The base includes a support platform that may be integrally connected to a column. The column, in turn, may be integrally connected to a ledge, which may be integrally connected to a stem. The stem may include a cap distally located from the ledge. The cap may be integrally formed with the stem. The spring is positioned around the stem.

The sleeve is secured to the stem and positioned around the spring. The spring is compressively biased between the sleeve and the ledge. The sleeve includes threads configured to threadably engage a reciprocal opening formed in the appliance. The sleeve may snapably secure to the cap. The sleeve is configured to move over the stem in relation to a change in the weight and/or movement of the appliance, wherein a portion of the sleeve slidably engages the column.

The base may also include at least one outer flattened surface, and the sleeve may include at least one inner flattened surface. The at least one outer flattened surface secures over the at least one inner flattened surface to prevent the base from rotating with respect to the sleeve.

Certain embodiments of the present invention also provide an appliance that includes a lower panel having a plurality of threaded openings, and at least one leveling foot. The at least one leveling foot is threadably secured in at least one of the plurality of threaded openings. Conventional feet assemblies may be secured in the remaining threaded openings. The appliance may include, for example, two, three, or four leveling feet.

Figure 1:
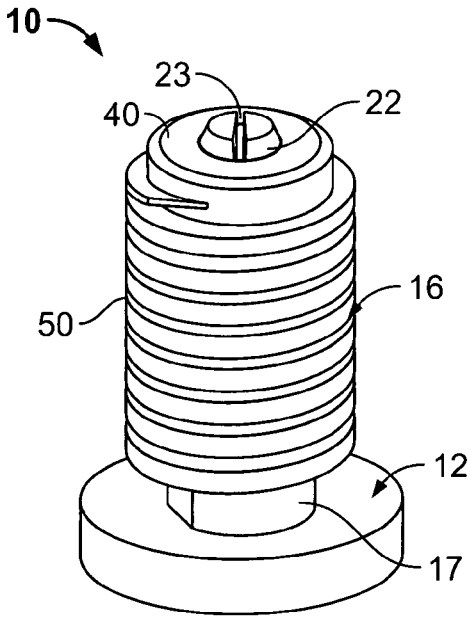
FIG. 1 illustrates an isometric view of a leveling assembly according to an embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

Figure 2:
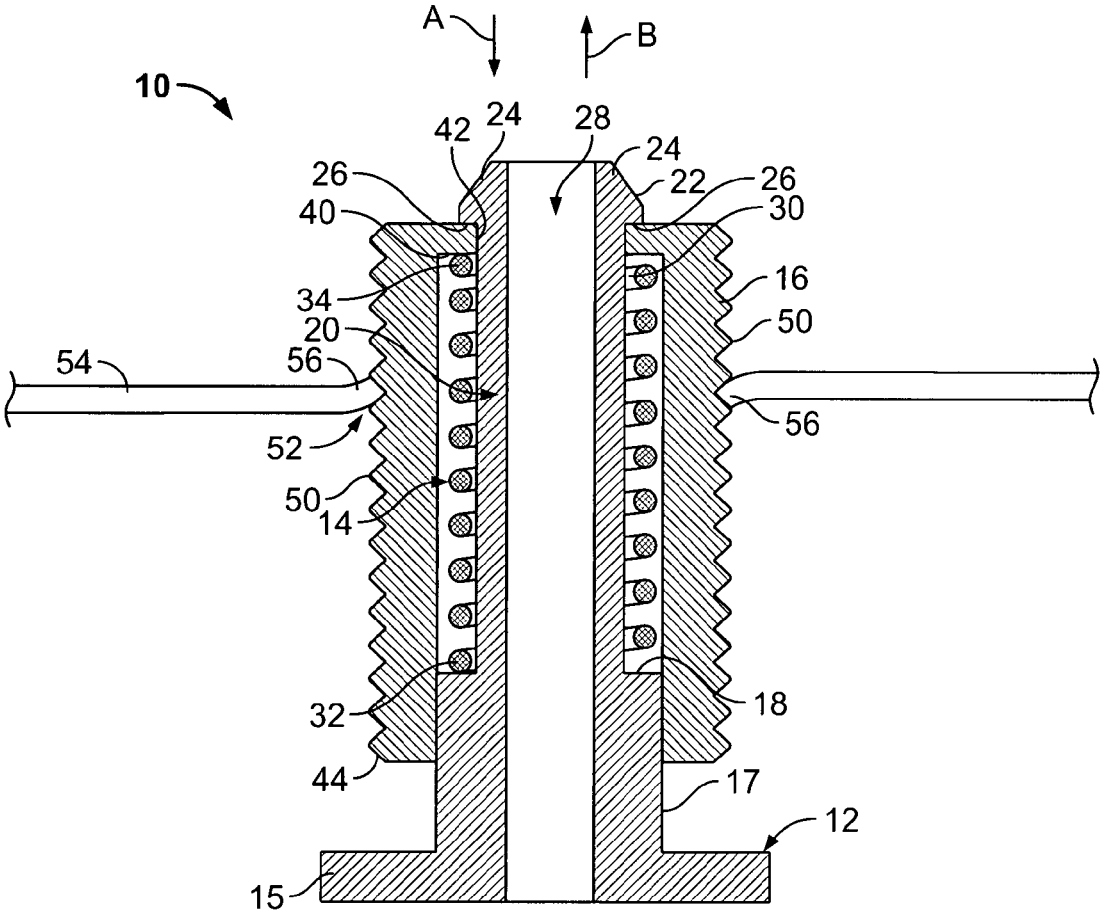
FIG. 2 illustrates a cross-sectional view of a leveling assembly according to an embodiment of the present invention.

FIG. 1 illustrates an isometric view of a leveling assembly 10 according to an embodiment of the present invention. FIG. 2 illustrates a cross-sectional view of a leveling assembly 10 according to an embodiment of the present invention. Referring to FIGS. 1 and 2, the leveling assembly 10 includes a base 12, a helical compression spring 14, and a sleeve 16. The base 12 and the sleeve 16 may be injection molded plastic, while the helical compression spring 14 may be a metal spring having a particular force constant.

The base 12 includes a supporting platform 15 integrally formed with an upright column 17. The supporting platform 15 may be circular, rectangular, or various other shapes, and is configured to support the leveling assembly 10 with respect to a floor. The upright column 17 includes an upper ledge 18 that supports, and is integrally formed with, an upright stem 20. One end of the stem 20 integrally connects to the ledge 18, while an opposite end of the stem 20 includes a cap 22. The cap 22 includes a circumferential ramped upper end 24 that outwardly and downwardly angles toward the platform 15 until the upper end 24 terminates at an abrupt straight edge or ridge 26. Additionally, a slot 23 may be formed through the cap 22. The slot 23 allows the cap 22 to flex when the sleeve 16 is snapably secured to the stem 20. As shown in FIG. 2, the base 12 may include a central hollow core 28. Optionally, the base 12 may be solid throughout.

The spring 14 defines a central passage 30 that allows the spring 14 to be positioned around the stem 20. That is, the spring 14 may be slip fit over the stem 20. A bottom end 32 of the spring 14 abuts the ledge 18, while an upper end 34 of the spring 14 is configured to abut an underside of the sleeve 16. Thus, the spring 14 may be compressed between the ledge 18 and the sleeve 16. The spring 14 may be designed to have a force constant suitable for load and weight characteristics of a washing machine. That is, the spring 14 may have a particular force constant that is configured to dampen vibrations produced by an operating washing machine.

The sleeve 16 is positioned over the spring 14 and the stem 20. The sleeve 16 may be a hollow open-ended cylinder that is urged toward and over the stem 20 in the direction of arrow A. An upper end 40 of the sleeve 16 includes an opening 42 that has a smaller diameter than that of the ramped upper end 24 proximate the straight edge 26. As the edges of the sleeve 16 that define the opening 42 move over the ramped upper end 24 in the direction of arrow A, the cap 22 snapably secures the sleeve 16 in place as the edges that define the opening 42 inwardly snap in place after moving past the ramped upper end 24. Once the sleeve 16 snaps into place, the upper end 34 of the spring 14 exerts an upwardly directed force in the direction of arrow B into an underside of the upper end 40 of the sleeve 16. Simultaneously, the spring 14 exerts a downwardly directed force in the direction of arrow A into a top surface of the ledge 18. In short, the spring 14 is compressively biased into both the upper end 40 of the sleeve 16 and the top surface of the ledge 18. The sleeve 16 is prevented from ejecting from the stem 20 in the direction of arrow B by the straight edge 26 of the cap 22. Further, the sleeve 16 is prevented from ejecting from the stem 20 in the direction of arrow A by the ledge 18.

The lower end 44 of the sleeve 16 slidably engages around the upright column 17 of the base 12. Thus, a force exerted into the sleeve 16 in the direction of arrow A causes the sleeve 16 to move down in the same direction, thereby compressing the spring 14. At the same time, the lower end 44 of the sleeve 16 slides over the column 17 in the same direction.

Outer surfaces 50 of the sleeve 16 may be threaded. The threaded outer surfaces 50 allow the leveling assembly 10 to be threadably secured within a reciprocal opening 52 formed within an underside of an appliance 54. The underside of the appliance 54 may be, for example, a piece of sheet metal having a plurality of threaded holes 52 configured to threadably retain the sleeve 16.

When the sleeve 16 is threadably secured within the opening 52, the sleeve 16 is able to slide up and down the stem 20, compressing and decompressing the spring 14 in the process, depending on the amount of force exerted in either direction A or B. Thus, the leveling assembly 10 dampens vibrations and movement caused by the appliance to which it is secured.

Four leveling assemblies 10 may be screwed into helical thread impressions 56 in each corner of a bottom of an appliance 54. The weight of the appliance 54 is transmitted into the external threads 50 of the sleeves 16. The sleeves 16 are, in turn, supported by the compression springs 14. The springs 14 are configured to have a suitable force constant that allows compression or decompression in the directions of A and B that is proportional to the weight of the appliance 54. The spring 14 also compresses or decompresses due to fluctuations in weight and dynamic forces created during operation of the appliance 54. For example, as clothes are added into a washing machine, the weight of the washing machine changes. The leveling assemblies 10 automatically adjust and adapt to the changing weight and forces (such as during a spin cycle) of a particular appliance.

Alternatively, more or less leveling assemblies 10 may be used with respect to a particular machine or appliance. For example, an appliance may use one leveling assembly 10 and three conventional foot assemblies. In general, three points determine a plane. Thus, the three conventional foot assemblies may be set at a predetermined height during a manufacturing process. The single leveling assembly 10 may be set to extend beyond the plane defined by the three conventional foot assemblies. When the appliance is positioned on a substantially level floor, three conventional foot assemblies determine the mounting plane of the appliance. The single leveling assembly 10 compresses to match the mounting plane, thereby automatically leveling the appliance. The single leveling assembly 10 also serves to dampen subsequent vibrations due to load imbalances.

Figure 3:
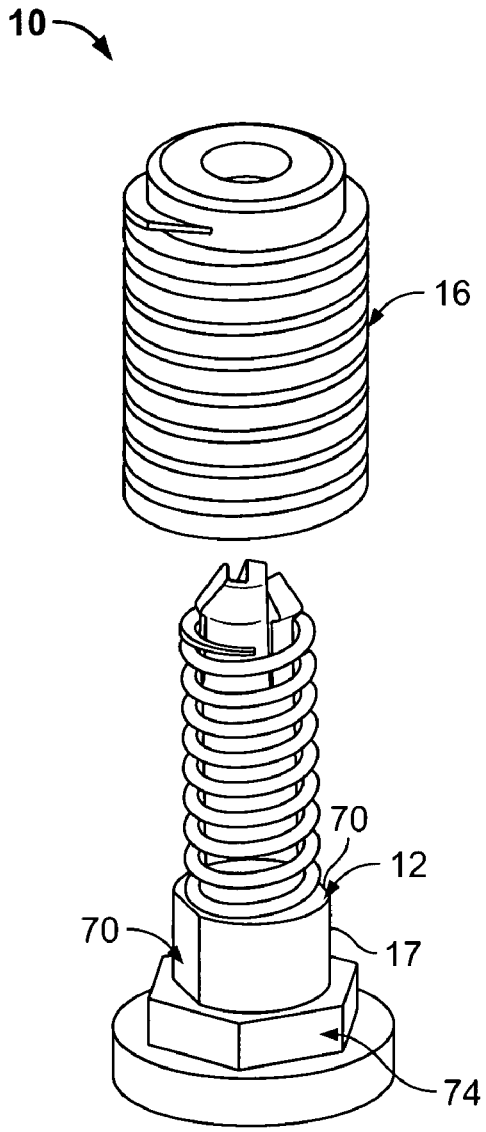
FIG. 3 illustrates an isometric exploded top view of a leveling assembly according to an embodiment of the present invention.
Figure 4:
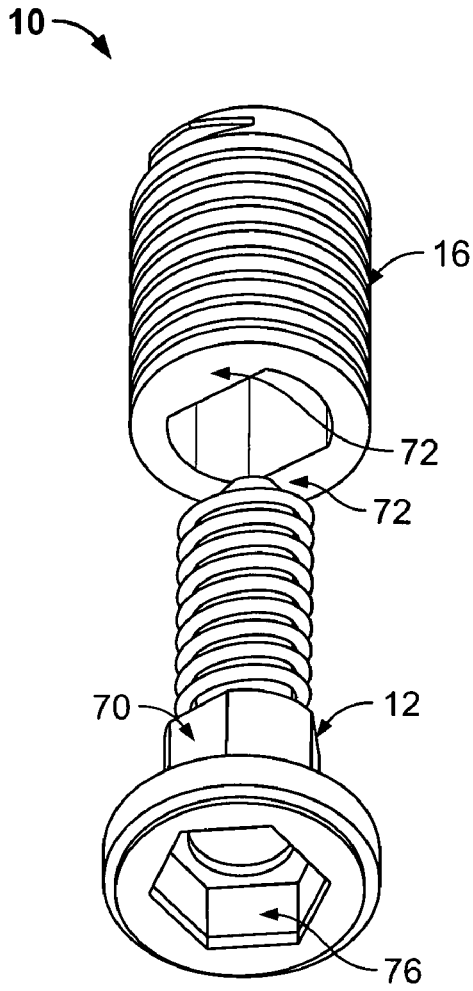
FIG. 4 illustrates an isometric exploded bottom view of a leveling assembly according to an embodiment of the present invention.

FIGS. 3 and 4 illustrate isometric exploded top and bottom views, respectively, of the leveling assembly 10 according to an embodiment of the present invention. Referring to FIGS. 3 and 4, the upright column 17 may include flattened surfaces 70. As shown in FIG. 3, for example, the upright column 17 may include two flattened surfaces 70 that are evenly spaced about the perimeter of the upright column 17. Optionally, more or less flattened surfaces 70 may be used.

The flattened surfaces 70 are configured to lockingly engage reciprocal flat surfaces 72 formed on an interior surface of the sleeve 16. Additionally, a portion of the column 17 below the flattened surfaces 17 may also include an outer hexagonal drive surface 74 and an internal hexagonal drive surface 76. A tool may be used to engage the drives surfaces 74 and 76 to secure the leveling assembly 10 to an appliance. The flattened surfaces 70 of the base 12 transfer the tightening torque to the reciprocal flattened surfaces 72 of the sleeve 16. The interaction of the flattened surfaces 70 of the base 12 and the reciprocal flattened surfaces 72 of the sleeve 16 ensure that the base 12 does not rotate relative to the sleeve 16 when the leveling assembly 10 is threadably secured to an appliance.

Thus, embodiments of the present invention provide a leveling foot assembly that automatically adjusts based on changes in weight and/or operating forces. The leveling foot assembly automatically dampens vibrations or other movements caused by an appliance to which the assembly is attached.

While various spatial terms, such as front, rear, upper, bottom, lower, mid, lateral, horizontal, vertical, and the like may used to describe embodiments of the present invention, it is understood that such terms are merely used with respect to the orientations shown in the drawings. The orientations may be inverted, rotated, or otherwise changed, such that a front portion is a rear portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A leveling assembly configured to be secured to an appliance, wherein the leveling assembly supports the appliance on a floor, the leveling assembly comprising:

a base having a supporting platform, a column extending from said platform, an inwardly extending ledge at an end of the column, and a stem extending from said ledge;

a spring positioned around said stem, wherein one end of said spring rests on said ledge; and a sleeve secured to said stem and positioned around said spring, said spring exerting equal and opposite forces into said sleeve and said ledge, respectively;

wherein said base further comprises at least one outer flattened surface, wherein said sleeve further comprises at least one inner flattened surface, wherein said at least one inner flattened surface secures over said at least one outer flattened surface, and wherein a portion of said sleeve slidably engages said column.

2. The leveling assembly of claim 1, wherein said sleeve is configured to move over said stem in relation to a change in at least one of weight and movement of the appliance.

3. The leveling assembly of claim 1, wherein said sleeve comprises threads configured to threadably engage a reciprocal opening formed in the appliance.

4. The leveling assembly of claim 1, wherein said stem comprises a ramped cap distally located from said ledge, said sleeve snapably securing to said ramped cap.

5. The leveling assembly of claim 1, wherein the appliance is a washing machine.

6. An appliance, comprising:

a lower panel having a plurality of threaded openings;

at least one leveling foot, wherein said at least one leveling foot is threadably secured in at least one of said plurality of threaded openings, said at least one leveling foot comprising:

a base having a support platform connected to a column, said column being connected to a ledge, said ledge being connected to a stem;

a spring positioned around said stem; and a sleeve secured to said stem and positioned around said spring, said spring being compressively biased between said sleeve and said ledge, wherein said sleeve comprises threads configured to threadably engage one of said plurality of threaded openings, and wherein said stem comprises a ramped cap distally located from said ledge, and said sleeve snapably securing to said ramped cap.

7. The appliance of claim 6, wherein said sleeve is configured to move over said stem in relation to a change in at least one of weight and movement of the appliance.

8. The appliance of claim 6, wherein a portion of said sleeve slidably engages said column.

9. The appliance of claim 6, wherein said lower panel comprises a housing wall of a washing machine.

10. The appliance of claim 6, comprising at least two leveling feet.

11. The appliance of claim 6, comprising four leveling feet.

12. The appliance of claim 6, wherein said base further comprises at least one outer flattened surface, wherein said sleeve further comprises at least one inner flattened surface, and wherein said at least one inner flattened surface secures over said at least one outer flattened surface.

13. A leveling assembly configured to be secured to an appliance, wherein the leveling assembly supports the appliance on a floor, the leveling assembly comprising:

a base having a support platform integrally connected to a column, said column being integrally connected to a ledge, said ledge being integrally connected to a stem, said stem comprising a cap distally located from said ledge;

a spring positioned around said stem; and a sleeve secured to said stem and positioned around said spring, said spring being compressively biased between said sleeve and said ledge, said sleeve comprising threads configured to threadably engage a reciprocal opening formed in the appliance, said sleeve snapably securing to said cap, and said sleeve being configured to move over said stem in relation to a change in at least one of weight and movement of the appliance, wherein a portion of said sleeve slidably engages said column.

14. The leveling assembly of claim 13, wherein the appliance is a washing machine.

15. The leveling assembly of claim 13, wherein said base further comprises at least one outer flattened surface, wherein said sleeve further comprises at least one inner flattened surface, and wherein said at least one outer flattened surface secures over said at least one inner flattened surface.

* * * * *